US010480763B2

(12) United States Patent
Mandlekar et al.

(10) Patent No.: US 10,480,763 B2
(45) Date of Patent: Nov. 19, 2019

(54) ENCLOSURE FOR LIGHTING SYSTEMS

(71) Applicant: Appleton Grp LLC, Rosemont, IL (US)

(72) Inventors: Karan C. Mandlekar, Pune (IN); Harsha N. Devappa, Pune (IN); Sumit Kumar, Pune (IN); Timothy E. Graff, Arlington Heights, IL (US)

(73) Assignee: Appleton Grp LLC, Rosemont, IL (US)

( * ) Notice: Subject to any disclaimer, the term of this patent is extended or adjusted under 35 U.S.C. 154(b) by 0 days.

(21) Appl. No.: 15/449,309

(22) Filed: Mar. 3, 2017

(65) Prior Publication Data

US 2018/0003370 A1 Jan. 4, 2018

(30) Foreign Application Priority Data

Jun. 30, 2016 (IN) ..... 201621022592

(51) Int. Cl.
*F21V 23/00* (2015.01)
*F21V 29/76* (2015.01)
(Continued)

(52) U.S. Cl.
CPC ..... *F21V 23/005* (2013.01); *F21V 5/04* (2013.01); *F21V 29/76* (2015.01); *F21V 29/85* (2015.01); *F21Y 2115/10* (2016.08)

(58) Field of Classification Search
CPC ..... F21V 23/005; F21V 29/76; F21V 29/85; F21V 5/04
(Continued)

(56) References Cited

U.S. PATENT DOCUMENTS 5,174,642 A 12/1992 Brohard et al.
7,654,703 B2 2/2010 Kan et al.
(Continued)

FOREIGN PATENT DOCUMENTS

CN 102966856 3/2013
CN 103557449 2/2014

OTHER PUBLICATIONS

ARRAN LED Floodlight, CH-DS-ARRAN-IND-V3, Sep. 2015, http://www.chalmit.com/more/on/details/00072, 2 pages.
(Continued)

*Primary Examiner* — Elmito Breval
(74) *Attorney, Agent, or Firm* — McDonnell Boehnen Hulbert & Berghoff LLP

(57) ABSTRACT

The present disclosure relates to the field of lighting systems. The collective dissipation of heat by various components of lighting systems, inside a conventional single compartment enclosure, raises the temperature of each of the components, resulting in damage and reduction in the life of the components. The present disclosure, therefore, envisages an enclosure for lighting systems which is compartmentalized, and prevents overheating of the components of the lighting systems. The enclosure includes a first compartment and a second compartment. At least one driver is receivable in the first compartment and at least one light emitting component is receivable in the second compartment. The first compartment is insulated from the second compartment. The enclosure is primarily used for lighting fixtures which require high efficiency operation from a compact package, or lighting fixtures which operate in rugged environments at high temperatures.

14 Claims, 7 Drawing Sheets

(51) Int. Cl.
*F21V 29/85* (2015.01)
*F21V 5/04* (2006.01)
*F21Y 115/10* (2016.01)

(58) Field of Classification Search
USPC ..... 362/249.01
See application file for complete search history.

(56) References Cited

U.S. PATENT DOCUMENTS

| | | | | |
|---|---|---|---|---|
| 7,828,465 | B2 | 11/2010 | Roberge et al. | |
| 7,997,761 | B2 | 8/2011 | Peck et al. | |
| D693,501 | S | 11/2013 | Kochman | |
| 8,764,243 | B2 | 7/2014 | Zimmer et al. | |
| 8,911,116 | B2 | 12/2014 | Blincoe et al. | |
| 9,022,621 | B2 | 5/2015 | Boyer et al. | |
| 2009/0262542 | A1 | 10/2009 | Li et al. | |
| 2011/0242828 | A1* | 10/2011 | Blincoe ..... | F21V 29/004 362/373 |

OTHER PUBLICATIONS

Chalmit, LED Solutions, 2015, http://www.gunneman.nl/wp-content/uploads/2015/05/Chalmit-LED-Solutions.pdf, 36 pages.

Champ® FMV Series LED Floodlight Fixtures, http://www.cooperindustries.com/content/public/en/crouse-hinds/products/lighting/led_luminaires/champ_fmv_led_series_floodlight_fixtures.html, downloaded Aug. 16, 2016, 10 pages.

Dialight LED Lighting Fixture Catalogue for Industrial and Hazardous Areas, Feb. 2016, 60 pages.

Hadar Lighting, HDL206E—Emergency Modular LED Luminaire, https://www.google.com/search?q=Modular+LED+Luminaire&tbm=isch&tbo=u&source=univ&sa=X&ved=0ahUKEwi11eGS5p7NAhUQPVIKHcSqALwQsAQIHQ&biw=1920&bih=973#imgrc=jEy1aGRccvMuiM%3A, downloaded Aug. 16, 2016, 1 page.

17,500 Lumen C1D1 Explosion Proof 150 Watt High Bay LED Light Fixture—Paint Spray Booth Approved, Spec Sheet, http://www.larsonelectronics.com/p-70368-class-1-division-1-explosion-proof-150-watt-high-bay-led-light-fixture-paint-spray-booth-approved.aspx, downloaded Aug. 16, 2016, 7 pages.

Hazardous Location LED Fixture, 240W, https://www.zoro.com/larson-electronics-llc-hazardous-location-led-fixture-240w-hal-hb-240w-rsled/i/G8021937/, downloaded Aug. 16, 2016, 5 pages.

"SafeSite LED Floodlight—UL 844 for Indoor and Outdoor Hazardous Applications," Dialight, MDTEXSSCIDIIFLX001_K, www.dialight.com pre-2016 Dialight Brochure, 12 pages.

PCT International Seach Report and Written Opinion, PCT International Application No. PCT/IB2017/051193, dated Apr. 26, 2017, 10 pages.

First Examination Report (FER) for Indian Patent Application No. 201621022592 dated Jan. 21, 2019, pp. 1-6.

* cited by examiner

ENCLOSURE FOR LIGHTING SYSTEMS

FIELD

The present disclosure relates to the field of electrical engineering, and more particularly, to the field of lighting systems.

DEFINITIONS

The term "Light Emitting Components" used hereinafter in the specification refers to any electrical or electronic component configured to convert electrical energy into light energy, including but not limited to all types of LEDs, Fluorescent lamps, incandescent light bulbs, gas lamps, laser lamps, light tubes, halogen lamps, light projection devices, and combinations thereof.

BACKGROUND

There is a tremendous growth in the demand of lighting systems in homes, flood lights, bay lights, industrial lighting, and street lighting systems, and a consequent increase in the demand of light emitting components, such as LEDs, CFLs, halogens, etc. The light emitting components and other associated components of a lighting system are typically housed together within a single compartment and are configured to convert electrical energy into light energy, in a manner that results in the generation and dissipation of heat within the lighting system. Take an example of an array of light emitting diodes (LEDs), where a significant portion of the applied current is subsequently converted into thermal energy. Also, the associated components of the array of light emitting diodes (LEDs), such as LED Array Board, LED drivers, light reflectors, and wiring are configured to dissipate heat during the conversion of electrical energy into light energy. The LED drivers, in particular, have a limitation in that they can function only up to a critical temperature. In case, the temperature of the LED drivers rises above the critical temperature, the concerned LED driver degrades, thereby reducing the performance of the lighting system. The collective dissipation of heat inside the single compartment by the components of the lighting system raises the temperature of each of the components above critical levels, resulting in damage to the components of the lighting system, and reduces their life in the process.

Further, high operating temperatures degrade the efficiency of the lighting systems. For example, typical LED lighting systems have lifetimes approaching 100,000 hours at room temperature, whereas, the same LED lighting system has a lifetime of less than 20,000 hours when operated at temperatures close to 90° C. LED lighting systems having an array of LEDs are utilized as light sources in a wide variety of applications and have specifically proven to be useful in applications where extremely bright light is required. In such applications, extremely bright LED light sources are used, which require the production of high lumens of light from a small and compact package, thereby generating a large amount of heat inside a relatively small space. Furthermore, LEDs are also used in sealed, enclosed lighting fixtures, where the sealed enclosure is required to prevent the introduction of environmental elements into the lighting systems.

There is, therefore, felt a need for an enclosure for lighting systems that alleviates the aforementioned drawbacks.

Objects

Some of the objects of the present disclosure, which at least one embodiment herein satisfies, are as follows.

It is an object of the present disclosure to ameliorate one or more problems of the prior art or to at least provide a useful alternative.

An object of the present disclosure is to provide an enclosure for lighting systems.

Another object of the present disclosure is to provide enclosures for lighting systems which are compartmentalized.

Still another object of the present disclosure is to provide enclosures for lighting systems which prevent overheating of the components of the lighting systems.

Other objects and advantages of the present disclosure will be more apparent from the following description, which is not intended to limit the scope of the present disclosure.

SUMMARY

The present disclosure envisages an enclosure for lighting systems. The enclosure comprises a first compartment provided in a first housing and a second compartment provided in a second housing. The first housing is removably secured to the second housing. At least one driver is receivable in the first compartment and is configured to generate a plurality of driving signals. At least one light emitting component is receivable in the second compartment and is configured to receive the plurality of driving signals. The first compartment is isolated from the second compartment.

In an embodiment, the enclosure includes a third compartment provided in the first housing. A plurality of wires are receivable in the third compartment. The plurality of wires are connected to the at least one driver and the at least one light emitting component. The plurality of wires are configured to carry the plurality of driving signals from the at least one driver to the at least one light emitting component.

In another embodiment, a wall is provided in between the first housing and the second housing. The wall is adapted to reduce transfer of heat between the first compartment and the second compartment.

In yet another embodiment, the enclosure includes a first gasket disposed in the first housing. The first gasket is adapted to provide a thermal break between the first housing and the second housing. In still another embodiment, the enclosure includes a second gasket disposed in the second housing and adapted to provide a thermal insulation to the second housing.

In yet another embodiment, a first plurality of fins are configured on the first housing. The first housing is configured to absorb excess heat generated by the at least one driver and dissipate the excess heat by means of the first plurality of fins.

In still another embodiment, the second compartment includes a heat sink provided with a second plurality of fins. The heat sink is configured to absorb excess heat generated by the at least one light emitting component and dissipate the excess heat by means of the second plurality of fins.

Typically, the first gasket and the second gasket are made of silicone based rubber or low thermally conductive rubber or combinations thereof. Preferably, the first housing, the second housing, the first plurality of fins, and the second plurality of fins are made of a material selected from the group consisting of extruded Aluminium, high-density pressure die-cast material, cold forged Aluminium, Aluminium alloys with less than 0.4% Copper, and combinations thereof.

In yet another embodiment, the enclosure includes two drivers received on either operative end of the first compartment. The two drivers are disposed in the first compartment in an axially spaced apart configuration. In still another embodiment, each of the first plurality of fins provided on either of the axially opposite sides of the first housing, proximal to the two drivers disposed in the first compartment, has a profile which facilitates dissipation of the excess heat generated by each of the two drivers. In yet another embodiment, the profile of each of the first plurality of fins, provided on either of the axially opposite sides of the first housing, includes a raised portion configured on an operative free end of each fin.

Typically, the relative optimum thickness of the wall ranges from 10 mm to 16 mm.

BRIEF DESCRIPTION OF THE ACCOMPANYING DRAWING

An enclosure for lighting systems of the present disclosure will now be described with the help of the accompanying drawing, in which.

Figure 1A:
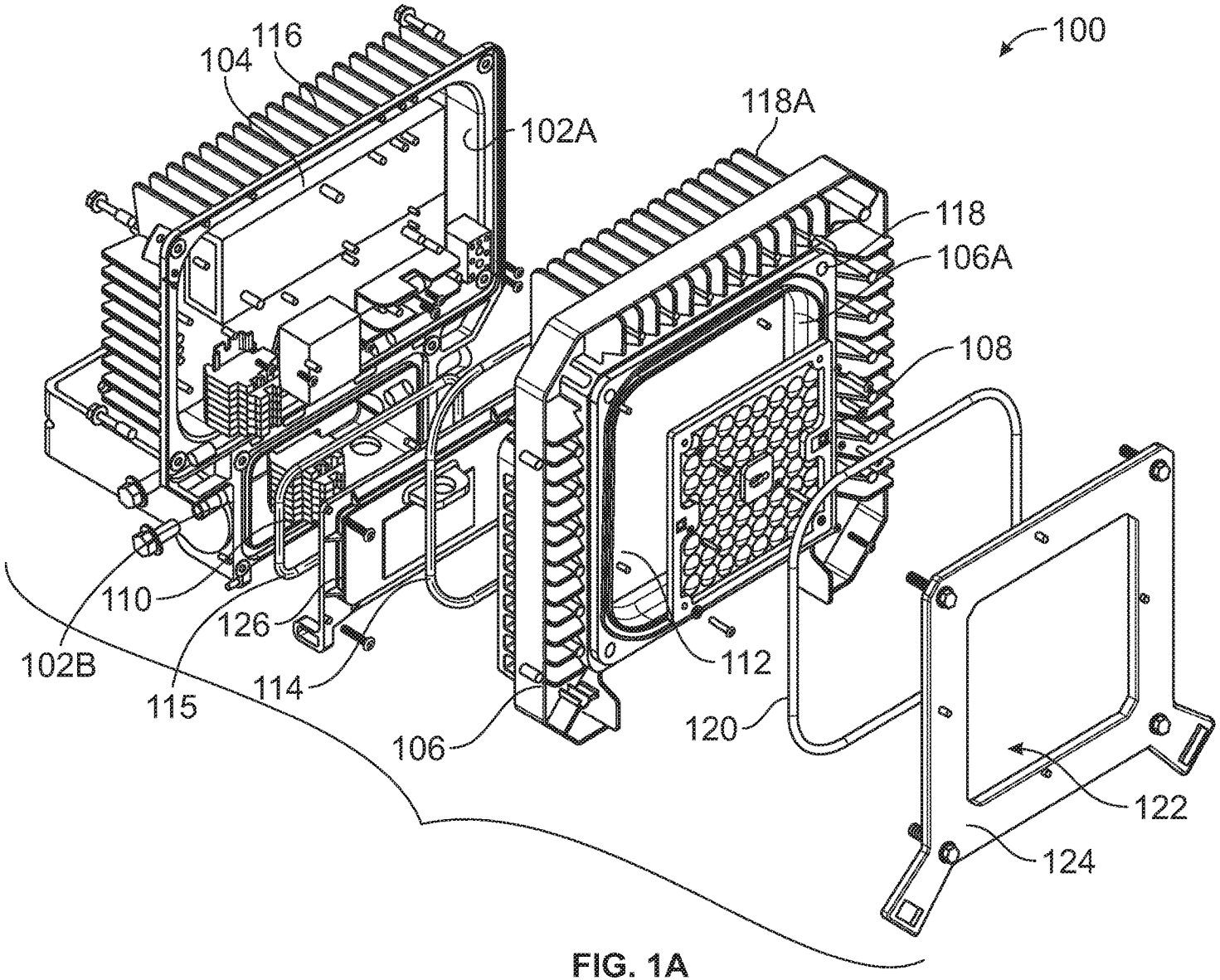
FIG. 1A illustrates an exploded view of the enclosure along with a lighting system in accordance with an embodiment of the present disclosure.
Figure 2A:
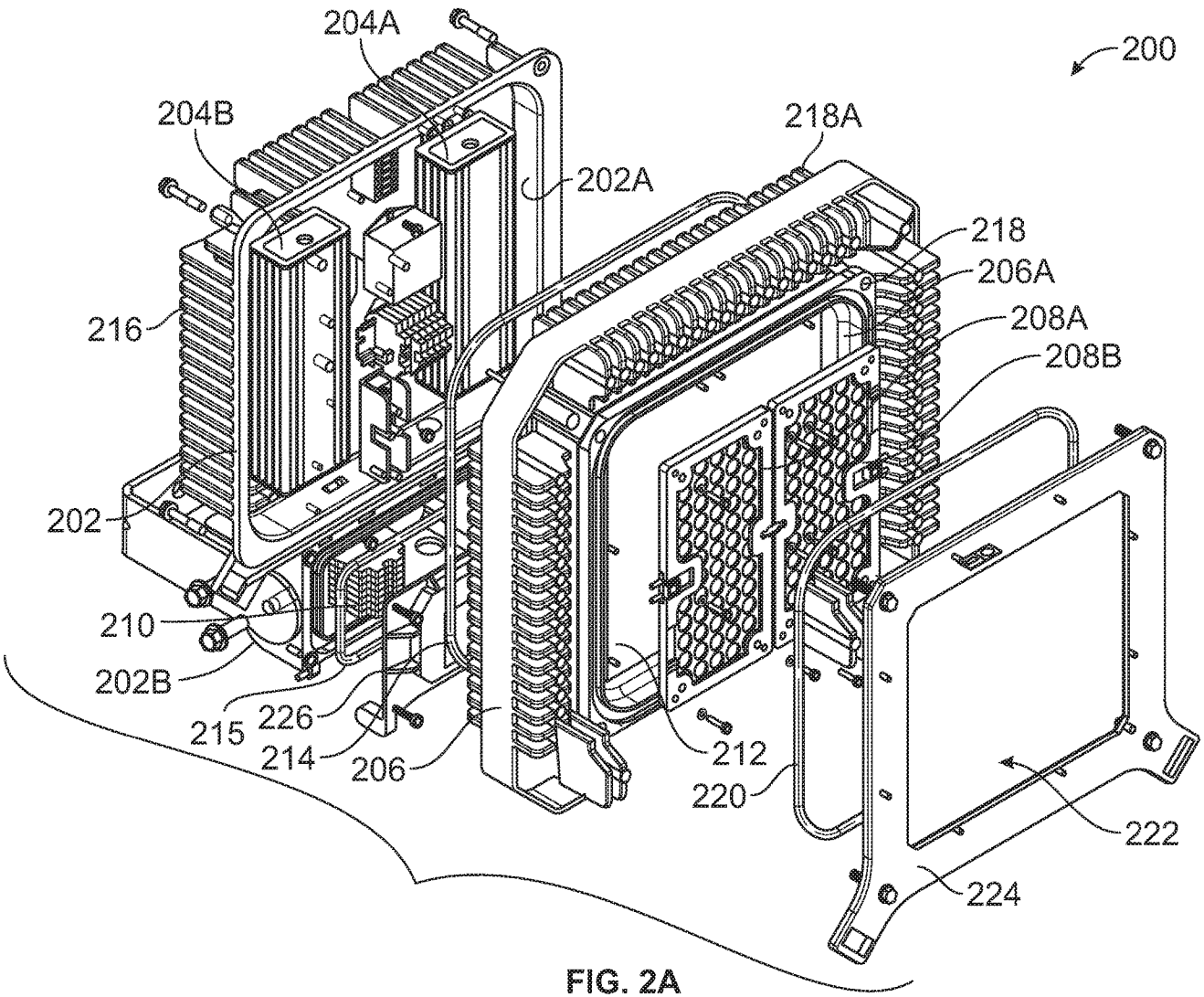
FIG. 2A illustrates an exploded view of an enclosure along with a lighting system in accordance with another embodiment of the present disclosure.
Figure 3A:
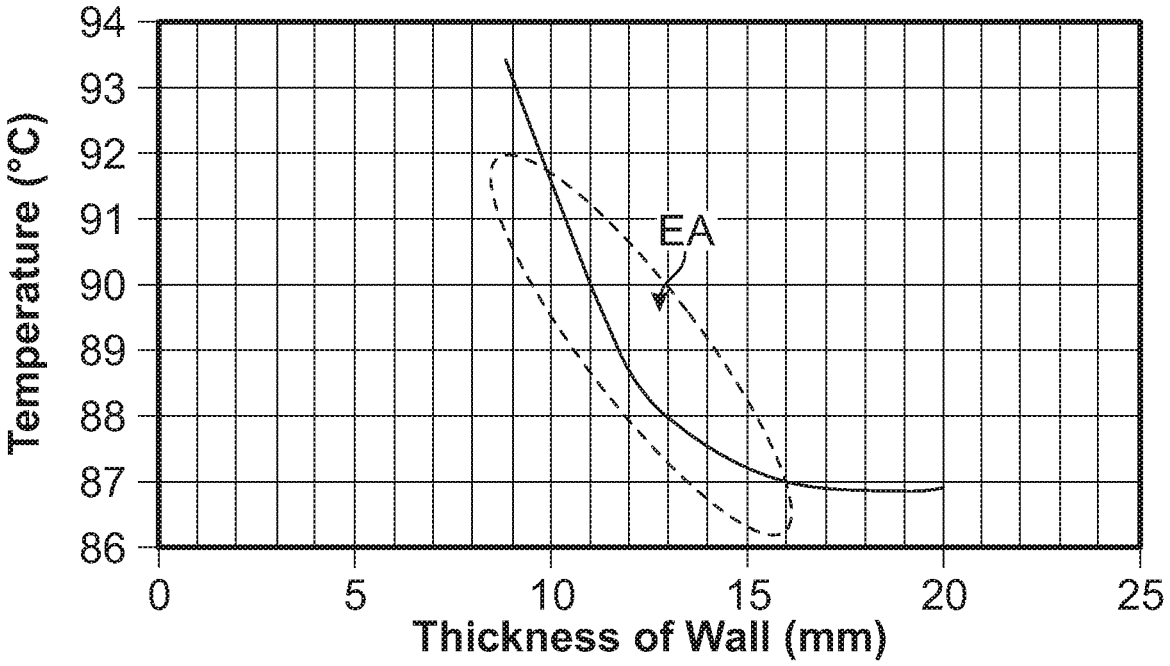
FIG. 3A illustrates a graphical representation of the relation between the thickness of a wall provided between a first compartment and a second compartment and the consequent hot spot temperature of a light emitting component of the enclosure of FIGS. 1A and 2A.
Figure 3B:
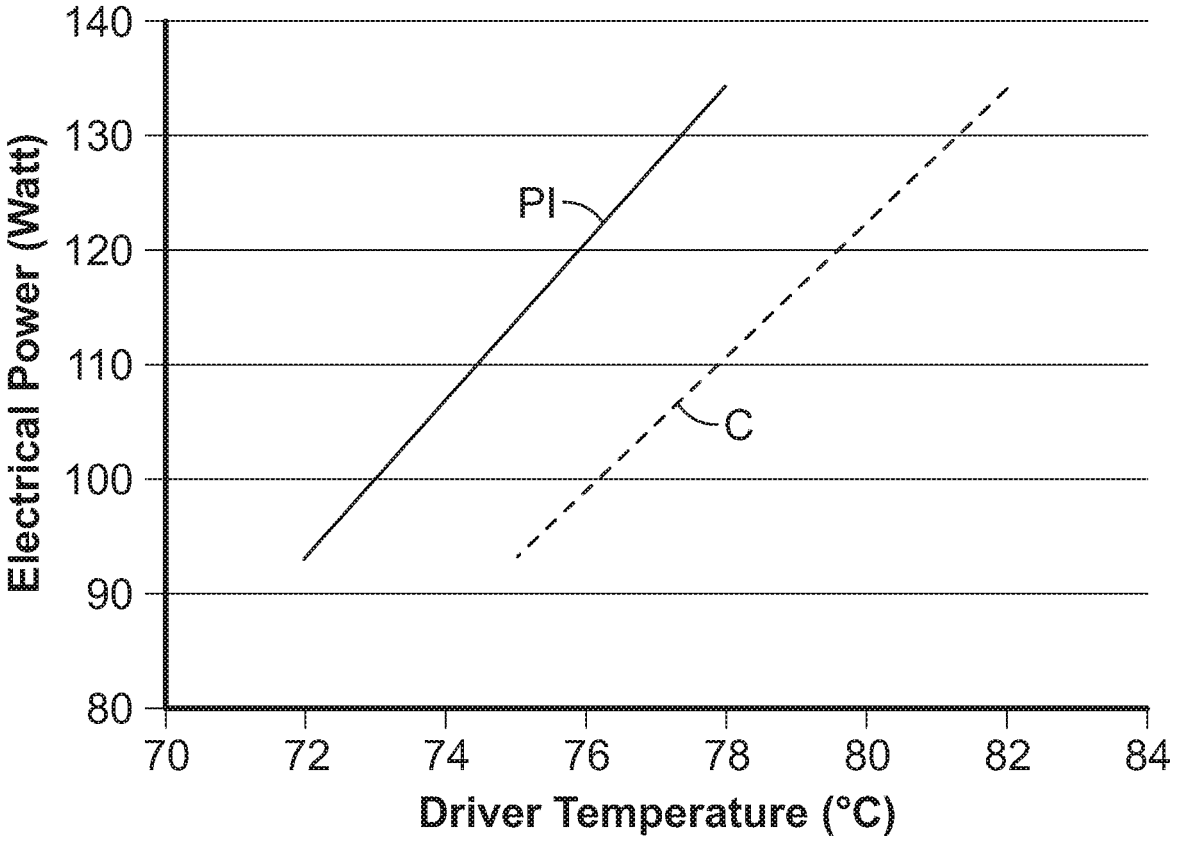
Figure 3C:
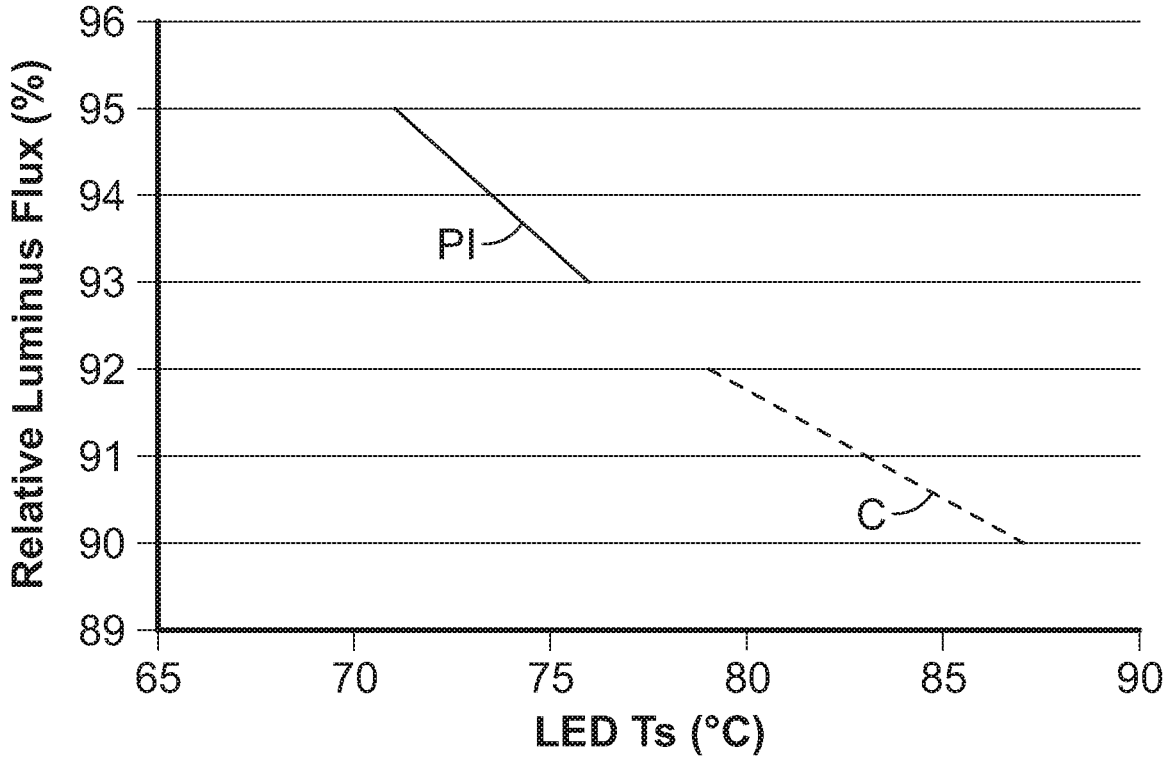

FIG. 3B illustrates a graphical representation of the relation between the electric power supplied to a driver and the consequent rise in temperature of the driver, for both, the lighting system disposed in a conventional enclosure (C) and the lighting system disposed in the enclosure of FIGS. 1A and 2A (PI); and FIG. 3C illustrates a graphical representation of the rise in solder point temperature of the light emitting component and the consequent rise in luminous flux produced by the light emitting component, for both, the lighting system disposed in a conventional enclosure (C) and the lighting system disposed in the enclosure of FIGS. 1A and 2A (PI).

TABLE illustrates various components of the present invention that are represented by the following reference numerals:

| Component | Reference Numeral |
|---|---|
| Enclosure for Lighting Systems | 100, 200 |
| First Compartment | 102A, 202A |
| First Housing | 102, 202 |
| At Least One Driver | 104, 204A, 204B |
| Second Compartment | 106A, 206A |

-continued

| Component | Reference Numeral |
|---|---|
| Second Housing | 106, 206 |
| At Least One Light Emitting Component | 108, 208A, 208B |
| Third Compartment | 102B |
| Plurality Of Wires | 110, 210 |
| Wall | 112, 212 |
| First Gasket | 114, 214 |
| First Plurality Of Fins | 116, 216 |
| Raised Portion | 216a |
| Heat Sink | 118, 218 |
| Second Plurality Of Fins | 118A, 218A |
| Second Gasket | 120, 220 |
| Glass Lens | 122, 222 |
| Lens Cover | 124, 224 |
| Third Compartment Cover | 126, 226 |
| Outer Wall Boundary | OW |
| Protected Zone | PZ |
| Effective Conduction Area | EA |
| Present Disclosure | PI |
| Conventional | C |

DETAILED DESCRIPTION

The enclosure (100) for lighting systems having at least two compartments comprises a first compartment (102A) provided in a first housing (102) and a second compartment (106A) provided in a second housing (106). At least one driver (104) is receivable in the first compartment (102A) and is configured to generate a plurality of driving signals. At least one light emitting component (108) is receivable in the second compartment (106A) and is configured to receive the plurality of driving signals. The first housing (102) is removably secured to the second housing (106), the first compartment (102A) is insulated from the second compartment (106A). In an embodiment, the enclosure (100) includes a third compartment (102B) provided in the first housing (102), and a plurality of wires (110) receivable in the third compartment (102B). A gasket 115 is positioned between third compartment 102B and third compartment cover 126. The plurality of wires (110) are connected to the at least one driver (104) and the at least one light emitting component (108), and are configured to carry the plurality of driving signals from the at least one driver (104) to the at least one light emitting component (108). In another embodiment, the second housing (106) is provided with a glass lens (122) along with reflectors and a lens cover (124), disposed directly below the operative surface of the at least one light emitting component (108), to facilitate the effective illumination of the surrounding region.

The present disclosure, therefore, envisages an enclosure (100) for lighting systems which is compartmentalized, and prevents overheating of the components of the lighting systems.

FIG. 1A illustrates an exploded view of the enclosure (100) along with a lighting system in accordance with an embodiment of the present disclosure.

Figure 1B:
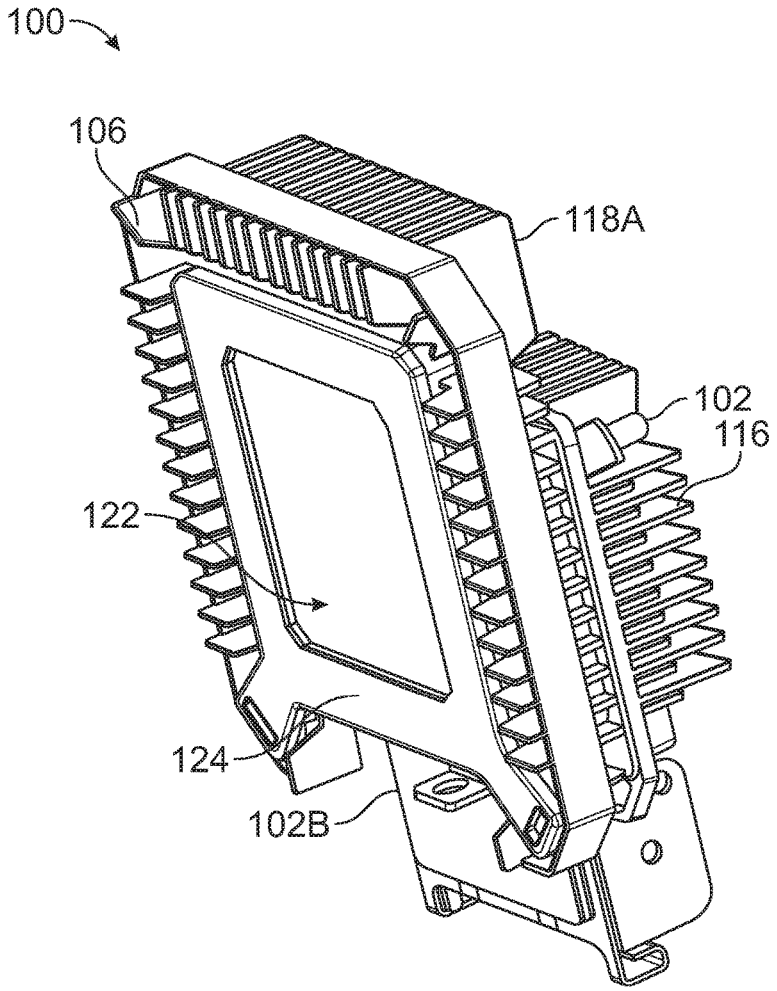
FIG. 1B illustrates an isometric view of the enclosure of FIG. 1A.

FIG. 1B illustrates an isometric view of the enclosure (100) of FIG. 1A.

The enclosure (100) for lighting systems having at least two compartments comprises a first compartment (102A) provided in a first housing (102) and a second compartment (106A) provided in a second housing (106). At least one driver (104) is receivable in the first compartment (102A) and is configured to generate a plurality of driving signals. At least one light emitting component (108) is receivable in the second compartment (106A) and is configured to receive the plurality of driving signals. The first housing (102) is removably secured to the second housing (106), the first compartment (102A) is insulated from the second compartment (106A). In an embodiment, the enclosure (100) includes a third compartment (102B) provided in the first housing (102), and a plurality of wires (110) receivable in the third compartment (102B). The plurality of wires (110) are connected to the at least one driver (104) and the at least one light emitting component (108), and are configured to carry the plurality of driving signals from the at least one driver (104) to the at least one light emitting component (108). In another embodiment, the second housing (106) is provided with a glass lens (122) along with reflectors and a lens cover (124), disposed directly below the operative surface of the at least one light emitting component (108), to facilitate the effective illumination of the surrounding region.

Figure 1C:
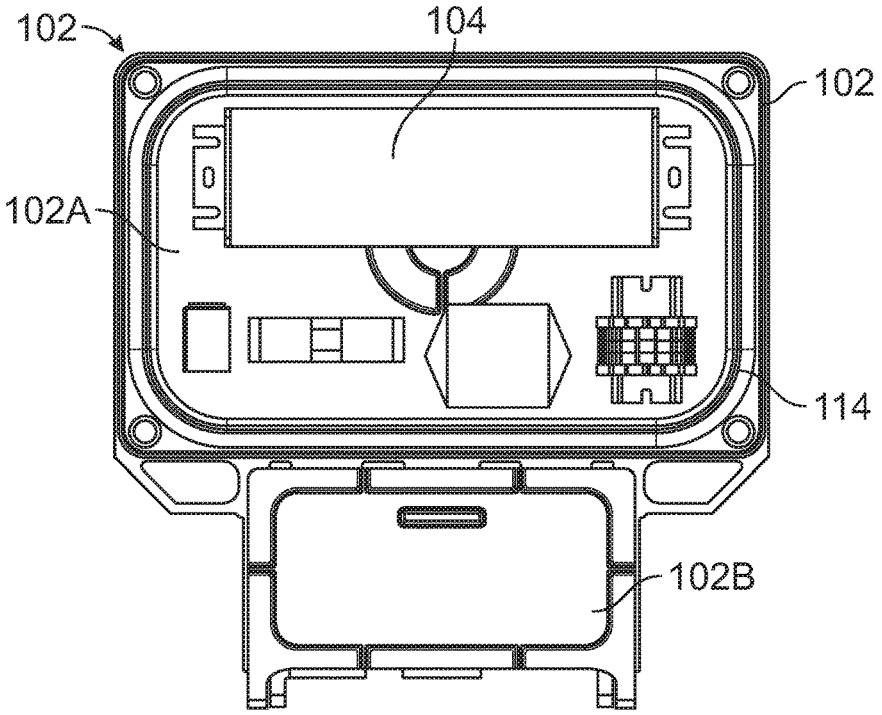
FIG. 1C illustrates a schematic view of a first housing of the enclosure of FIG. 1A.
Figure 1D:
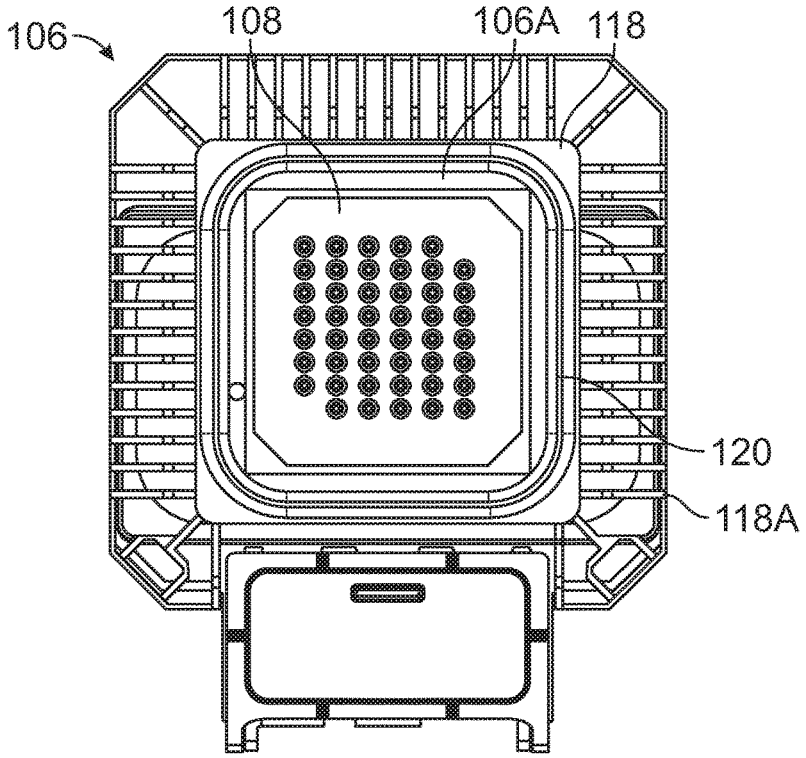
FIG. 1D illustrates a schematic view of a second housing of the enclosure of FIG. 1A.

FIG. 1C illustrates a schematic view of the first housing (102) and FIG. 1D illustrates a schematic view of the second housing (106) of the enclosure (100) of FIG. 1A.

In an exemplary embodiment, where the at least one light emitting component (108) is an LED matrix, there are three mechanisms for dissipation of thermal energy from the LED array (108), viz. conduction, radiation, and convection. Conduction occurs when the LED chips, the mechanical structure of the LEDs, the LED mounting structure (such as printed circuit boards) are placed in physical contact with the second housing (106). Radiation is the dissipation of heat energy via electromagnetic propagation and much of the radiant energy escapes the LED array (108) through the glass lens (122), which is designed to redirect the radiant energy (visible light in particular) out of the enclosure (100). Further, the radiant energy that does not escape through the glass lens (122) is absorbed within the enclosure (100) and is converted into heat. Convection occurs at any surface exposed to air, depending on the amount of air movement near the surface of the heat emitting components of the enclosure (100), the surface area available for heat dissipation, and the difference between the temperature of the emitting surface and the surrounding air. LED Driver is a composite structure in which internal components generate heat. These internal components are encapsulated in epoxy and are further covered by Aluminium case. Heat travels through conduction from internal driver components to epoxy and to the outer Aluminium case. From the outer Aluminium case, heat travels through all three mechanisms of heat transfer.

There are two major sources of heat in the enclosure (100), namely the at least one driver (104) and the at least one light emitting component (108). The separation of the at least one driver (104) in the first compartment (102A), the at least one light emitting component (108) in the second compartment (106A), and also the plurality of wires (110) in the third compartment (102B) increases the total heat conduction path and reduces the transfer of heat between the at least one driver (104) and the at least one light emitting component (108).

In an exemplary embodiment, thermal simulation and testing carried out comparing a single compartment enclosure of conventional lighting systems and the multi-compartment enclosure of the present disclosure shows a 6% reduction in critical temperature $T_c$ of the at least one driver (104) (cut-off temperature for driver functioning). In alternative exemplary embodiments, a comparison between a single compartment enclosure of conventional lighting systems and the multi-compartment enclosure of the present disclosure shows a 15% reduction in the temperature of the at least one light emitting component (108) without the glass lens (122) and a 13% reduction in the temperature of the at least one light emitting component (108) with the glass lens (122).

In another embodiment, a wall (112) (as seen in FIG. 1*a*) is provided in between the first housing and the second housing (106). The wall (112) is adapted to reduce transfer of heat between the first compartment (102A) and the second compartment (106A).

In yet another embodiment, the enclosure (100) also includes a first gasket (114) disposed in the first housing (102). The first gasket (114) is adapted to provide a thermal break between the at least one driver (104) and the at least one light emitting component (108). In still another embodiment, the enclosure (100) further includes a second gasket (120) disposed in the second housing (106). The second gasket (120) is adapted to provide a thermal insulation to the at least one light emitting component (108).

In still another embodiment, a first plurality of fins (116) are configured on the first housing (102). The first housing (102) is configured to absorb excess heat generated by the at least one driver (104) and dissipate the excess heat by means of the first plurality of fins (116). In yet another embodiment, the second compartment (106A) includes a heat sink (118) provided with a second plurality of fins (118A). The heat sink (118) is configured to absorb excess heat generated by the at least one light emitting component (108) and dissipate the excess heat by means of the second plurality of fins (118A).

Thus, as can be seen from FIGS. 1A-1D, the compartmental design of the enclosure (100) provides separate compartments for the components of the lighting system. The first compartment (102A) is provided for the at least one driver (104) in the first housing (102), wherein the first housing (102) itself acts as a heat sink for the at least one driver (104). The second compartment is provided for the at least one light emitting component (108) in the second housing (106), which includes the heat sink (118) for the at least one light emitting component (108). Each of the first plurality of fins (116) and the second plurality of fins (118A) are adapted to dissipate the excess heat generated inside the enclosure (100) into the ambient air surrounding the enclosure (100) by means of convection. The spacing between individual fins is optimized for maximum heat reception and dissipation, which facilitates cooling of the components housed in the respective compartments (102A, 106A).

Typically, the first gasket (114) and the second gasket (120) are made of silicone based rubber or low thermally conductive rubber or combinations thereof. Preferably, the first housing (102), the second housing (106), the first plurality of fins (116), the second plurality of fins (118A) are made of a material selected from the group consisting of extruded Aluminium, high-density pressure die-cast material, sand cast Aluminium, cold forged Aluminium, Aluminium alloys with less than 0.4% Copper, and combinations thereof.

The first gasket (114) and the second gasket (120) are made of a material having a lower thermal conductivity as compared to the first housing (102) and the second housing (106), which allows for them to act as a thermal break. In an exemplary embodiment, the first housing (102) and the second housing (106) are made of sand cast Aluminium, having a thermal conductivity in the range of 110 to 160 W/mK (Watts per meter Kelvin), whereas each of the first gasket (114) and the second gasket (120) are made of silicon rubber having a thermal conductivity of 0.43 W/mK.

Each of the first gasket (114) and the second gasket (120) are additionally adapted to act as an environmental seal, and prevent ingress of water and other environmental elements into the enclosure (100).

In still another embodiment, an enclosure (200) includes two drivers (204A, 204B) received on either operative end of a first compartment (202A) characterized in that the two drivers (204A, 204B) are disposed in the first compartment (202A) in an axially spaced apart configuration. The first compartment (202A) is provided in a first housing (202).

FIG. 2A illustrates an exploded view of the enclosure (200) along with a lighting system.

The enclosure (200) further includes a second compartment (206A), a second housing (206), two light emitting components (208A, 208B), a third compartment (206B), a plurality of wires (210), a wall (212), a first gasket (214), a first plurality of fins (216), a heat sink (218), a second plurality of fins (218A), a second gasket (220), a glass lens (222), a lens cover (224), and a third compartment cover (226), having the same configuration and similar functions as those of the corresponding components of the enclosure (100). A gasket 215 is positioned between third compartment 202B and third compartment cover 226.

In yet another embodiment, each of the first plurality of fins (216) provided on either of the axially opposite sides of the first housing (202), proximal to the two drivers (204A, 204B) disposed in the first compartment (202A), has a profile which facilitates dissipation of the excess heat generated by each of the two drivers (204A, 204B).

Figure 2B:
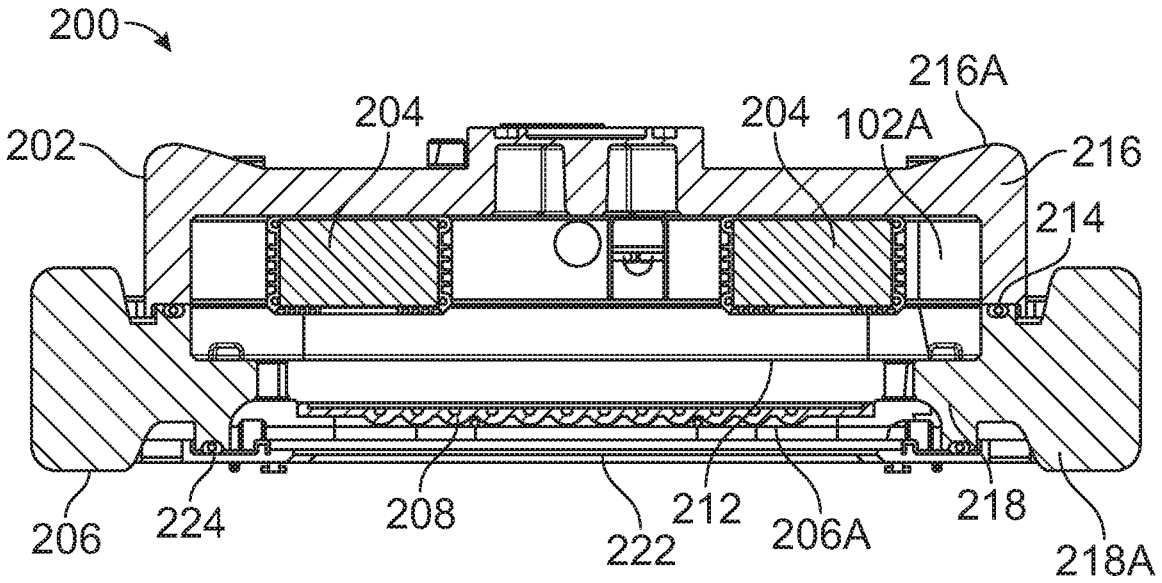
FIG. 2B illustrates a cross-sectional view of the enclosure of FIG. 2A.

FIG. 2B illustrates a cross-sectional view of the enclosure (200) of FIG. 2A.

In still another embodiment, the profile of each of the first plurality of fins (216), provided on either of the axially opposite sides of the first housing (202), includes a raised portion (216*a*) configured on an operative free end of each fin.

Figure 2C:
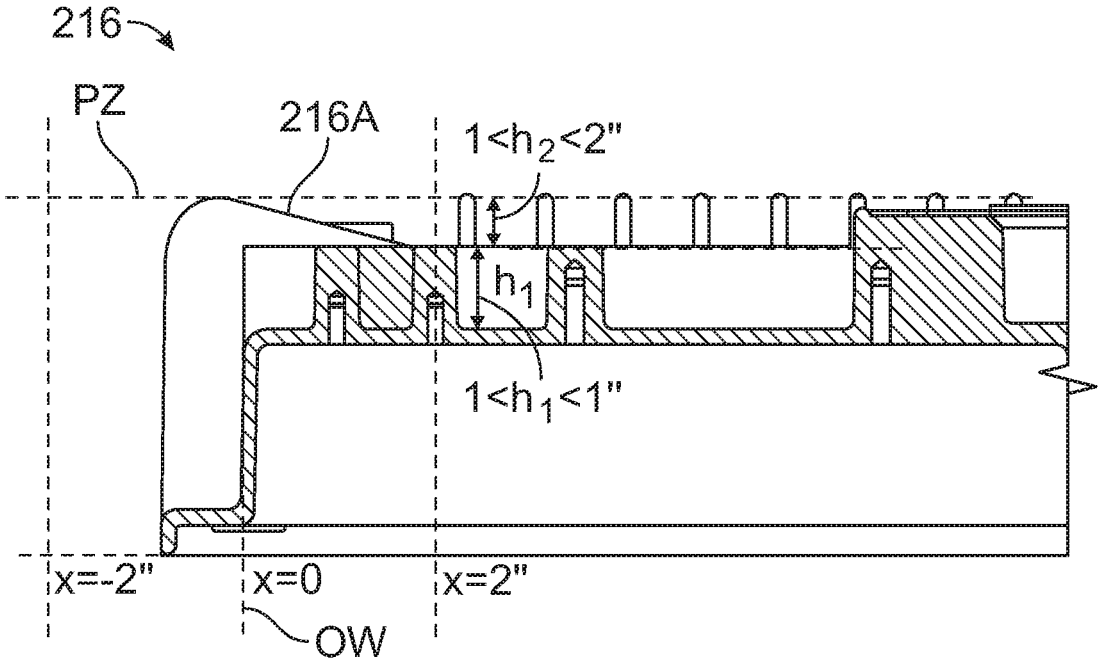
FIG. 2C illustrates a sectional view of one fin from a first plurality of fins of the enclosure of FIG. 2A.

FIG. 2C illustrates a sectional view of one fin from the first plurality of fins (216), provided on either of the axially opposite sides of the first housing (202) of the enclosure (200) of FIG. 2A. The raised portion (216*a*) exhibits a higher heat transfer coefficient as compared to the conventional fin (of a perfectly rectangular shape) which accelerates cooling of the two drivers (204A, 204B). In yet another embodiment, the raised portion (216*a*) can be a combination of multiple inclines, or a combination of inclines and curves, or a combination of multiple curves.

As can be gathered from FIG. 2C, the height of the raised portion (216*a*) is defined relative to the height above the base fin height (h1) and its location is defined with respect to the outer wall boundary (OW) not containing the fin (x). In FIG. 2C, the base fin height ($h_1$) is the height of the fin with respect to the fin base at a location where the raised portion (216*a*) begins to rise and a maximum raised fin height ($h_2$) is the height of the raised portion (216*a*) with respect to the base fin height ($h_1$). Further, x=0 represents the extension of fin beyond the outer wall boundary (OW) not containing the fin. In an exemplary embodiment (as illustrated in FIG. 2C), it has been observed that for the fin including the raised portion (216*a*) a protected zone (PZ) can be (approximately) defined by

- the fin extendable between from x=−2" (50.8 mm) from the outer wall boundary (OW) to x=+2" (50.8 mm) beyond the outer wall boundary (OW),
- the base fin height ($h_1$) varying from 0 to 1" (25.4 mm), and
- the raised fin height ($h_2$) varying from 0 to 2" (50.8 mm), wherein the dissipation of excess heat gathered from the two drivers (204A, 204B) is enhanced. The angle of inclination of the fin, defining the raised portion (216*a*), can be calculated using the ratio of the raised fin height ($h_2$) and the extension of the fin (x) beyond the outer wall boundary (OW).

As can be gathered from FIGS. 2A, 2B, and 2C, the two drivers (204A, 204B) are disposed away from the center of the first compartment (202A) and in the proximity of the raised portion (216*a*) of the first plurality of fins (216), provided on either of the axially opposite sides of the first housing (202), which accelerates cooling of the two drivers (204A, 204B). Further, owing to lower driver temperatures, more Lumens can be pumped through the same lighting system disposed in the enclosure (200) as compared to the conventional enclosures. Increasing the overall fin area of the second plurality of fins (218A) of the heat sink (218) can further lower the temperature of the two light emitting components (208A, 208B) but at the cost of overall weight of the enclosure (200).

In an exemplary embodiment of the enclosure (100, 200) of the present disclosure, the lighting system is an LED lighting system wherein the at least one light emitting component (108, 208A, 208B) is an LED array and the at least one driver (104, 204A, 204B) is an LED driver.

In an embodiment, materials having a high thermal conduction and absorption properties can be used to fabricate the wall (112, 212), in order to increase its heat transfer and absorption capability. The material of the wall (112, 212) provides a low resistance—highly conductive path to the excess heat, and further facilitates the absorption and dissipation of the excess heat. FIG. 3A illustrates a graphical representation of the thickness of the wall (112) provided between the first compartment (102A) and the second compartment (106A), and the consequent hot spot temperature of the LED array (108, 208A, 208B) of the enclosure (100, 200). The increase in thickness of the wall (112) increases a conduction area (effective conduction area—EA) for the heat from the LED array (108, 208A, 208B) and reduces the heat spreading resistance. The conduction area (EA) of the wall (112, 212) is made greater than the conduction area of the wall connecting the first housing (102, 202) and the second housing (106, 206), thereby reducing the transfer of heat from the first compartment (102A, 202A) to the second compartment (106A, 206A), which further reduces the hot spot temperatures of the LED array (108, 208A, 208B). In an implementation of the exemplary embodiment, increasing the thickness of the wall (112, 212) from 10 mm to 16 mm reduces the hot spot temperature of the LED array (108, 208A, 208B) by 5%. Further increasing the thickness of the wall (112, 212) can further reduce hot spot temperature, but at the cost of overall weight of the enclosure (100, 200). Typically, the wall (112, 212) has a relative optimum thickness ranging from 10 mm to 16 mm.

FIG. 3B illustrates a graphical representation of the electric power supplied to the LED driver (104, 204A, 204B) and the consequent rise in temperature of the LED driver (104, 204A, 204B), for both, a lighting system disposed in an enclosure conventionally used in the art (C) and the lighting system disposed in the enclosure (100, 200) of FIGS. 1A and 2A (PI). The LED driver (104, 204A, 204B) functions at a temperature which is cooler by 5% as compared to the driver disposed in the conventional enclosure, thereby improving the efficiency and life of the LED driver (104, 204A, 204B).

FIG. 3C illustrates a graphical representation of the rise in solder point temperature of the LED array (108, 208A, 208B) and the consequent rise in luminous flux produced by the LED array (108, 208A, 208B), for both the lighting system disposed in a conventional enclosure (C) and the lighting system disposed in the enclosure (100, 200) of FIGS. 1A and 2A (PI). The LED array (108, 208A, 208B) functions at a temperature which is cooler by 13% as compared to the LED array disposed in the conventional enclosure, thereby improving the efficiency and life of the at least one light emitting component (108, 208A, 208B).

A comparative study of the LED lighting systems disposed in conventional enclosures and the enclosure (100, 200) of the present disclosure shows a marked increase in efficiency of the lighting system disposed in the enclosure (100, 200).

| Electrical Power (93 W) | LED Driver Temp. (° C.) | Heat Sink Temp. (° C.) | LED array Temp (° C.) | Lumen Variation |
|---|---|---|---|---|
| Conventional | 75 | 77 | 79 | 92% absolute |
| Present Disclosure | 72 | 69 | 71 | 95% absolute |
| % age variation | 4 | 10 | 10 | 3% increase |

| Electrical Power (134 W) | LED Driver Temperature (° C.) | Heat Sink Temperature (° C.) | LED array Temperature (° C.) | Lumen Variation |
|---|---|---|---|---|
| Conventional | 82 | 85 | 87 | 90% absolute |
| Present Disclosure | 78 | 74 | 76 | 93% absolute |
| % age variation | 5 | 13 | 13 | 3% increase |

The Table hereinabove illustrates the LED systems operating at Electrical Powers of 93 Watts and 134 Watts and the consequent operating values of the following parameters of the LED lighting systems: LED driver temperature, Heat Sink temperature, LED temperature, and Lumen Variation. The table also provides the percentage variation in the aforementioned parameters. As can be observed from the table, the Lumen Variation for both LED systems, operating at different electrical power, shows a 3% increase when used in the enclosure (100, 200) of the present disclosure. Also, the decrease in the LED driver temperatures (4% and 5%), the heat sink temperatures (10% and 13%) and the LED array temperatures (10% and 13%) is significant, thereby increasing the life of each of the components.

In alternative embodiments, the wall (112, 212) can be replaced with thermal management components selected from the group consisting of heat pipes, graphite sheets, copper pads, and combinations thereof. Further, in another embodiment, the shape, and size of each of the first plurality of fins (116, 216) and the second plurality of fins (118A, 218A) can be optimized to adapt to varying heat dissipation requirements of the at least one driver (104, 204A, 204B) and the at least one light emitting component (108, 208A, 208B).

Thus, the various embodiments of the enclosure (100, 200) as discussed herein above provide for various lighting emitting components to be used with increased efficiency and reliability. Further, the enclosure (100, 200) of the present disclosure also provides ingress protection against environmental elements affecting the operation of lighting systems.

Technical Advances and Economical Significance

The present disclosure described herein above has several technical advantages including but not limited to the realization of an enclosure for lighting systems which:

provides separate compartments for the components of the lighting systems, prevents overheating of the components of the lighting systems, enhances the dissipation of excess heat generated by the lighting systems, enables the components of the lighting systems to function at optimum efficiency, increases the life of the driver, is compact and is made of a light material, and can be optimized for enclosing different types of lighting systems.

The disclosure will now be described with reference to the accompanying embodiments which do not limit the scope and ambit of the disclosure. The description provided is purely by way of example and illustration.

The embodiments hereinabove and the various features and advantageous details thereof are explained with reference to the non-limiting embodiments in the following description. Descriptions of well-known components and processing techniques are omitted so as to not unnecessarily obscure the embodiments herein.

The foregoing description of the specific embodiments so fully reveals the general nature of the embodiments hereinabove that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments hereinabove have been described in terms of preferred embodiments, those skilled in the art will recognize that the embodiments herein can be practiced with modification within the spirit and scope of the embodiments as described hereinabove.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

The use of the expression "at least" or "at least one" suggests the use of one or more elements or ingredients or quantities, as the use may be in the embodiment of the disclosure to achieve one or more of the desired objects or results.

Any discussion of documents, acts, materials, devices, articles or the like that has been included in this specification is solely for the purpose of providing a context for the disclosure. It is not to be taken as an admission that any or all of these matters form a part of the prior art base or were common general knowledge in the field relevant to the disclosure as it existed anywhere before the priority date of this application.

The numerical values mentioned for the various physical parameters, dimensions or quantities are only approximations and it is envisaged that the values higher/lower than the numerical values assigned to the parameters, dimensions or quantities fall within the scope of the disclosure, unless there is a statement in the specification specific to the contrary.

While considerable emphasis has been placed herein on the components and component parts of the preferred embodiments, it will be appreciated that many embodiments can be made and that many changes can be made in the preferred embodiments without departing from the principles of the disclosure. These and other changes in the preferred embodiment as well as other embodiments of the disclosure will be apparent to those skilled in the art from the disclosure herein, whereby it is to be distinctly understood that the foregoing descriptive matter is to be interpreted merely as illustrative of the disclosure and not as a limitation.

We claim:

1. An enclosure for lighting systems, said enclosure comprising:

i. a first compartment provided in a first housing;

ii. at least one driver receivable in said first compartment and configured to generate a plurality of driving signals;

iii. a second compartment provided in a second housing; and iv. at least one light emitting component receivable in said second compartment and configured to receive said plurality of driving signals;

wherein, said first housing is removably secured to said second housing; and said first compartment is insulated from said second compartment; and wherein a first gasket is positioned between the first housing and the second housing providing a seal between the first housing and the second housing and adapted to provide a thermal break between said at least one driver in the first compartment of the first housing and said at least one light emitting component positioned in the second compartment of the second housing.

2. The enclosure as claimed in claim 1, wherein a wall is provided in between said first housing and said second housing, and said wall is adapted to reduce transfer of heat between said first compartment and said second compartment.

3. The enclosure as claimed in claim 2, wherein the relative optimum thickness of said wall ranges from 10 mm to 16 mm.

4. The enclosure as claimed in claim 1, which includes a second gasket disposed in said second housing and adapted to provide a thermal insulation to said at least one light emitting component.

5. The enclosure as claimed in claim 4, wherein said first gasket and said second gasket are made of silicone based rubber or low thermally conductive rubber or combinations thereof.

6. The enclosure as claimed in claim 4, further including a third compartment positioned in the first housing, wherein a third gasket is positioned between the third compartment of the first housing and a third compartment cover providing a seal between the third compartment and the third compartment cover.

7. The enclosure as claimed in claim 1, wherein a first plurality of fins are configured on said first housing, characterized in that said first housing is configured to absorb excess heat generated by said at least one driver and dissipate the excess heat by means of said first plurality of fins.

8. The enclosure as claimed in claim 7, wherein said first housing, said second housing, said first plurality of fins, and said second plurality of fins are made of a material selected from the group consisting of extruded Aluminum, high-density pressure die-cast material, cold forged Aluminum, Aluminum alloys with less than 0.4% Copper, and combinations thereof.

9. The enclosure as claimed in claim 1, wherein said second compartment includes a heat sink provided with a second plurality of fins, characterized in that said heat sink is configured to absorb excess heat generated by said at least one light emitting component and dissipate the excess heat by means of said second plurality of fins.

10. The enclosure as claimed in claim 9, wherein said first housing, said second housing, said first plurality of fins, and said second plurality of fins are made of a material selected from the group consisting of extruded Aluminum, high-density pressure die-cast material, cold forged Aluminum, Aluminum alloys with less than 0.4% Copper, and combinations thereof.

11. The enclosure as claimed in claim 1, which includes two drivers received on either operative end of said first compartment characterized in that said two drivers are disposed in said first compartment in an axially spaced apart configuration.

12. The enclosure as claimed in claim 11, wherein each of said first plurality of fins provided on either of the axially opposite sides of said first housing, proximal to said two drivers disposed in said first compartment, has a profile which facilitates dissipation of the excess heat generated by each of said two drivers.

13. The enclosure as claimed in claim 12, wherein said profile of each of said first plurality of fins, provided on either of the axially opposite sides of said first housing, includes a raised portion configured on an operative free end of each fin.

14. An enclosure for lighting systems, said enclosure comprising:

i. a first compartment provided in a first housing;

ii. at least one driver receivable in said first compartment and configured to generate a plurality of driving signals;

iii. a second compartment provided in a second housing; and iv. at least one light emitting component receivable in said second compartment and configured to receive said plurality of driving signals;

wherein, said first housing is removably secured to said second housing; and said first compartment is insulated from said second compartment; and further including v. a third compartment provided in said first housing; and vi. a plurality of wires receivable in said third compartment, and connected to said at least one driver and said at least one light emitting component;

wherein said plurality of wires are configured to carry said plurality of driving signals from said at least one driver to said at least one light emitting component.

* * * * *